US010933635B2

(12) United States Patent
Takeuchi et al.

(10) Patent No.: US 10,933,635 B2
(45) Date of Patent: Mar. 2, 2021

(54) LIQUID EJECTION HEAD SUBSTRATE AND METHOD FOR MANUFACTURING THE SAME

(71) Applicant: CANON KABUSHIKI KAISHA, Tokyo (JP)

(72) Inventors: Souta Takeuchi, Fujisawa (JP); Takeru Yasuda, Kawasaki (JP); Kazuaki Shibata, Kawasaki (JP); Taichi Yonemoto, Isehara (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/701,996

(22) Filed: Dec. 3, 2019

(65) Prior Publication Data

US 2020/0189277 A1 Jun. 18, 2020

(30) Foreign Application Priority Data

Dec. 17, 2018 (JP) ..... JP2018-235022

(51) Int. Cl.
*B41J 2/14* (2006.01)
*B41J 2/16* (2006.01)

(52) U.S. Cl.
CPC ..... *B41J 2/14072* (2013.01); *B41J 2/14088* (2013.01); *B41J 2/14129* (2013.01); *B41J 2/162* (2013.01); *B41J 2/164* (2013.01); *B41J 2/1606* (2013.01); *B41J 2/1623* (2013.01); *B41J 2/1626* (2013.01); *B41J 2/1631* (2013.01); *B41J 2/1643* (2013.01); *B41J 2202/22* (2013.01); *Y10T 29/49401* (2015.01)

(58) Field of Classification Search
CPC ..... B41J 2/14072; B41J 2/14088; B41J 2/14129; B41J 2/1603; B41J 2/1606; B41J 2/162; B41J 2/1623; B41J 2/1628; B41J 2/1629; B41J 2/1631; B41J 2/164; B41J 2/1642; B41J 2/1643; B41J 2/1646; B41J 2202/22; Y10T 29/49401
See application file for complete search history.

(56) References Cited

U.S. PATENT DOCUMENTS

| | | | | |
|---|---|---|---|---|
| 6,945,629 | B2 | 9/2005 | Yamaguchi et al. | 347/48 |
| 6,962,405 | B2 | 11/2005 | Imanaka et al. | 347/58 |
| 7,255,426 | B2 | 8/2007 | Ibe et al. | 347/58 |
| 7,338,150 | B2 | 3/2008 | Ibe et al. | 347/55 |
| 7,374,275 | B2 | 5/2008 | Shibata et al. | 347/56 |
| 7,441,877 | B2 | 10/2008 | Kubo et al. | 347/58 |
| 7,533,969 | B2 | 5/2009 | Ozaki et al. | 347/61 |
| 7,566,116 | B2 | 7/2009 | Saito et al. | 347/64 |
| 7,614,726 | B2 | 11/2009 | Yamaguchi et al. | 347/58 |
| 7,621,612 | B2 | 11/2009 | Yamaguchi et al. | 347/17 |

(Continued)

FOREIGN PATENT DOCUMENTS

JP 2014-141040 A 8/2014

*Primary Examiner* — Anh T Vo
(74) *Attorney, Agent, or Firm* — Venable LLP

(57) ABSTRACT

Provided is a liquid ejection head substrate including: a substrate; a liquid ejection element that generates liquid ejection energy on the substrate; and an electrode pad that is electrically connected to the liquid ejection element, in which the electrode pad includes a barrier metal layer and a bonding layer on the barrier metal layer, and an end side surface of the barrier metal layer is covered with a silicon-based film containing carbon.

20 Claims, 5 Drawing Sheets

(56) References Cited

U.S. PATENT DOCUMENTS

| | | | | |
|---|---|---|---|---|
| 7,669,981 | B2 | 3/2010 | Ozaki et al. | 347/61 |
| 7,681,992 | B2 | 3/2010 | Omata et al. | 347/57 |
| 7,770,989 | B2 | 8/2010 | Matsui et al. | 347/9 |
| 7,810,892 | B2 | 10/2010 | Yamaguchi et al. | 347/5 |
| 7,810,907 | B2 | 10/2010 | Kubo et al. | 347/50 |
| 7,862,155 | B2 | 1/2011 | Shibata et al. | 347/58 |
| 7,896,455 | B2 | 3/2011 | Matsui et al. | 347/9 |
| 7,950,769 | B2 | 5/2011 | Sakai et al. | 347/22 |
| 7,954,238 | B2 | 6/2011 | Shibata et al. | 29/890.1 |
| 7,959,262 | B2 | 6/2011 | Omata et al. | 347/50 |
| 8,070,262 | B2 | 12/2011 | Yamaguchi et al. | 347/57 |
| 8,070,267 | B2 | 12/2011 | Takeuchi et al. | 347/67 |
| 8,075,102 | B2 | 12/2011 | Hatsui et al. | 347/58 |
| 8,123,330 | B2 | 2/2012 | Sakai et al. | 347/22 |
| 8,129,204 | B2 | 3/2012 | Saito et al. | 438/21 |
| 8,167,411 | B2 | 5/2012 | Takeuchi et al. | 347/57 |
| 8,191,996 | B2 | 6/2012 | Omata et al. | 347/57 |
| 8,231,195 | B2 | 7/2012 | Kubo et al. | 347/12 |
| 8,435,805 | B2 | 5/2013 | Yonemoto et al. | 438/21 |
| 8,438,729 | B2 * | 5/2013 | Ibe | B41J 2/1643<br>29/890.1 |
| 8,491,087 | B2 | 7/2013 | Sakai et al. | 347/22 |
| 9,050,805 | B2 | 6/2015 | Sakurai et al. | B41J 2/16 |
| 9,096,059 | B2 | 8/2015 | Hatsui et al. | B41J 2/14112 |
| 9,266,330 | B2 | 2/2016 | Fujii et al. | |
| 9,561,651 | B2 | 2/2017 | Hatsui et al. | B41J 2/14088 |
| 9,751,301 | B2 | 9/2017 | Takahashi et al. | B41J 2/04511 |
| 2007/0252873 | A1 | 11/2007 | Saito et al. | 347/63 |
| 2008/0094454 | A1 * | 4/2008 | Koyama | B41J 2/1603<br>347/61 |
| 2008/0129782 | A1 | 6/2008 | Kubo et al. | 347/50 |
| 2010/0079551 | A1 | 4/2010 | Saito et al. | 347/64 |
| 2014/0212998 | A1 | 7/2014 | Fujii et al. | |

* cited by examiner

LIQUID EJECTION HEAD SUBSTRATE AND METHOD FOR MANUFACTURING THE SAME

BACKGROUND OF THE INVENTION

Field of the Invention

The present invention relates to a liquid ejection head substrate and a method for manufacturing the same.

Description of the Related Art

A liquid ejection apparatus such an ink-jet recording apparatus has a liquid ejection head that ejects a liquid. The liquid ejection head typically has a substrate, a liquid ejection element that generates energy for ejecting a liquid on the substrate and an orifice plate, and a liquid ejection orifice from which the liquid is ejected is formed in the orifice plate. The liquid ejection head is provided with an externally connected electrode (hereinafter, also referred to as an "electrode pad") that establishes electrical connection for driving the liquid ejection element and establishes electrical connection using an implemented component such as a lead or a wire.

Japanese Patent Application Laid-Open No. 2014-141040 discloses that an electrode pad on a substrate is typically formed using gold. A configuration in which the electrode pad is protected with a resin member in order to enhance electrical reliability is disclosed instead of a configuration in which the electrode is simply formed. Specifically, the electrode pad is protected by applying an adhesiveness improving layer made of a resin for improving adhesiveness between an orifice plate and the substrate through spin-coating.

The size of ejected liquid droplets in an ink-jet recording apparatus has been further reduced with an increase in image quality in recent years, and correspondingly, the height of the orifice plate has been lowered, and higher precision in flatness has been required. Therefore, the liquid ejection apparatus has made a progress so as to have a more flattened substrate and a more thinned orifice plate and to employ a manufacturing method with no use of an adhesiveness improving layer.

SUMMARY OF THE INVENTION

If the thickness of the orifice plate is further reduced, there is no other option than to reduce the amount of the adhesiveness improving layer made of resin used in the spin-coating to a significantly small amount in terms of required precision of flattening, and it is difficult to protect the electrode pad with the adhesiveness improving layer made of resin as disclosed in Japanese Patent Application Laid-Open No. 2014-141040. Basically, it is not possible to protect the electrode pad using the adhesiveness improving layer in the method that does not use the adhesiveness improving layer.

Since an end of a barrier metal layer is exposed in an electrode pad in the related art, it is necessary to set a process that is durable against side etching in various kinds of wet processing such as resist development or resist separation in the manufacturing process in a case in which protection using the adhesiveness improving layer cannot be performed. Therefore, it is desirable to provide an electrode pad that can cope with side etching in wet processing in the manufacturing process.

It is an object of the present invention to provide a liquid ejection head substrate, in which side etching of a barrier metal layer in an electrode pad portion is curbed, which has improved electrical reliability, and a manufacturing method of the same.

In order to achieve the object, according to the invention, there is provided a liquid ejection head substrate including: a substrate; a liquid ejection element that generates liquid ejection energy on the substrate; and an electrode pad that is electrically connected to the liquid ejection element, wherein the electrode pad includes a barrier metal layer and a bonding layer on the barrier metal layer, and an end side surface of the barrier metal layer is covered with a silicon-based film containing carbon.

According to the invention, there is also provided a method for manufacturing a liquid ejection head substrate that includes a substrate, a liquid ejection element that generates liquid ejection energy on the substrate, and an electrode pad that includes a barrier metal layer and a bonding layer on the barrier metal layer and is electrically connected to the liquid ejection element, the method comprising: covering an end side surface of the barrier metal layer with a silicon-based film containing carbon.

Further features of the present invention will become apparent from the following description of exemplary embodiments with reference to the attached drawings.

DESCRIPTION OF THE EMBODIMENTS

Figure 1:
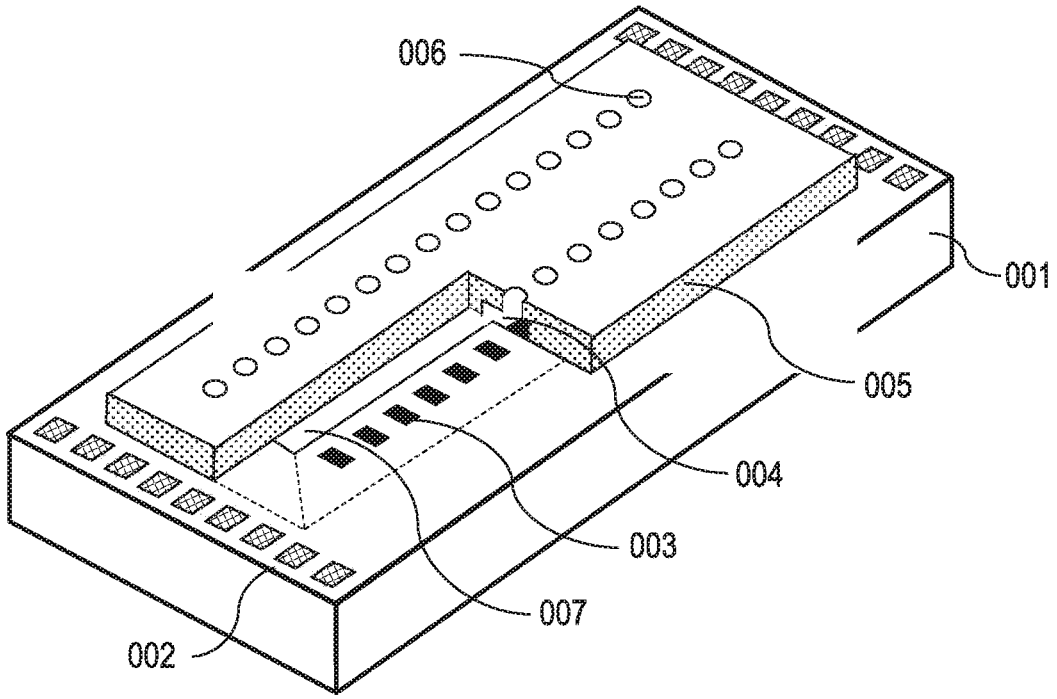
FIG. 1 is a schematic perspective view of an ink-jet recording head substrate according to the invention.

Hereinafter, an ink-jet recording head will be exemplified and described as an example of a liquid ejection head. FIG. 1 is a perspective view of an ink-jet recording head substrate according to the invention. FIG. 1 illustrates a liquid ejection orifice 006 facing upward. "Up" described in the specification indicates the side of the liquid ejection orifice 006 unless otherwise particularly indicated. The ink-jet recording head substrate has a substrate 001 provided with a liquid ejection element 003 (an electrothermal conversion element (heater) in the embodiment) that generates liquid ejection energy and an orifice plate 005 including the liquid ejection orifice 006 formed therein. In the ink-jet recording head, an ink is supplied from a liquid supply orifice 007 formed in the substrate 001 to a flow path 004. Then, the ink is ejected from the liquid ejection orifice 006 with the energy generated from the liquid ejection element 003, and the ink lands on a recording medium, thereby performing printing thereon. An electrode pad 002 that is electrically connected to the liquid ejection element 003 is provided on the ink-jet recording head substrate for driving the liquid ejection element 003, and a lead wiring is mounted on the electrode pad, thereby obtaining the ink-jet recording head.

Although the ink-jet recording head substrate and a method for manufacturing the same will be described below with reference to embodiments, the invention is not limited only to these embodiments.

First Embodiment

Hereinafter, a liquid ejection head substrate and a method for manufacturing the same according to an embodiment will be described with reference to FIGS. 2A to 2D. FIGS. 2A to 2D are schematic sectional views and are not intended to limit a positional relationship and directions of an electrode pad and a liquid ejection element. The same applies to FIGS. 3A to 5F.

First, a heater layer 12 with a thickness of about 30 nm that serves as a heat generation portion of the liquid ejection element 003 and an aluminum film with a thickness of 200 nm that serves as a heater wiring layer 33 (first wiring layer) are formed on an insulating film layer 10 provided on the substrate 001. Further, an SiN film with a thickness of 200 nm that serves as a heater protection film layer 22 for protecting the heater layer is formed. As the substrate 001, a silicon substrate can be used, for example. A material used for the insulating film layer 10 is not particularly limited as long as the material can perform insulation, and for example, a silicon-based material such as $SiO_2$ or SiN can be used. Examples of a material used for the heater layer 12 include hafnium boride, tantalum nitride and tantalum nitride silicon. Examples of a material used for the heater wiring layer 33 include aluminum, Al—Si, Al—Cu and copper. Examples of a material used for the heater protection film layer 22 include silicon oxide, silicon nitride and silicon oxynitride. Next, patterning is performed using photolithography, thereby obtaining a configuration illustrated in FIG. 2A. The heater protection film layer 22 has a through-hole 22*a* so as to enable electrical connection to the next layer. In this manner, the heater layer that serves as a heat generation portion extends as a layer below the first wiring layer, and the heat generation portion is formed in a region that is not covered with the first wiring layer in the embodiment. That is, electric power is supplied to the liquid ejection element 003 via the first wiring layer and the liquid ejection element 003 that serves as a heater generates heat. Also, the heater protection film layer is formed on the heater layer of the heat generation portion and on the first wiring layer.

Figure 2A:
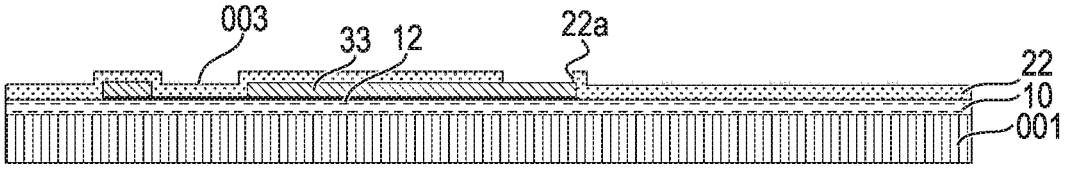
FIGS. 2A, 2B, 2C and 2D are diagrams illustrating a method for manufacturing an ink-jet recording head substrate according to a first embodiment.
Figure 2B:
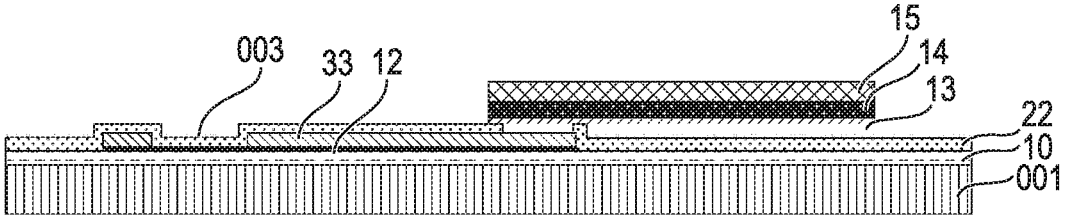

Next, an aluminum film with a thickness of 200 nm that serves as a wiring layer 13 (second wiring layer), a titanium tungsten film with a thickness of 200 nm that serves as a barrier metal layer 14 and a gold film with a thickness of 200 nm that serves as a bonding layer 15 are successively formed through sputtering. That is, the wiring layer 13 is provided between the heater wiring layer 33 and the barrier metal layer 14 in a lamination direction and establishes electrical connection between the heater wiring layer 33 and the barrier metal layer 14. As a material used for the wiring layer 13, it is possible to exemplify aluminum, Al—Si, Al—Cu, and copper, for example. In the embodiment, the heater wiring layer 33 and the wiring layer 13 may be formed using the same material or different materials as long as the heater wiring layer 33 and the wiring layer 13 are formed as independent layers. A material that forms the barrier metal layer 14 is preferably titanium-based metal or tantalum-based metal. Specifically, titanium tungsten, titanium nitride, tantalum nitride, and the like are exemplified. Although examples of a material that forms the bonding layer 15 include gold, nickel and copper, gold is preferably used in terms of bonding properties. Then, resist working is performed through photolithography, and patterning is then performed through successive etching of the bonding layer 15, the barrier metal layer 14, and the wiring layer 13 by an RIE method (FIG. 2B).

Figure 2C:
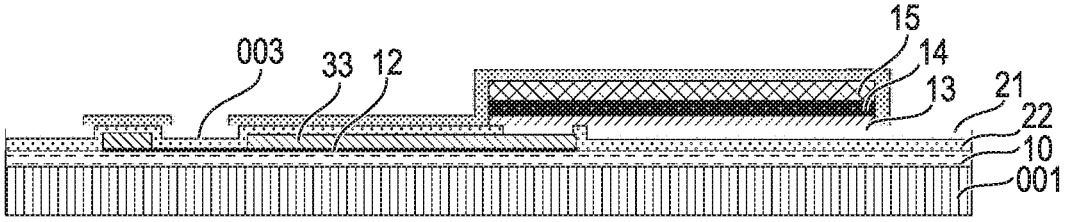

After the bonding layer is formed, an SiCN film with a thickness of 500 nm that serves as a silicon-based film layer 21 containing carbon is formed on the entire surface through low-temperature plasma CVD at 150° C. The silicon-based film containing carbon that forms the silicon-based film layer containing carbon preferably includes an SiCN film or an SiC film with alkali resistance. A film formation temperature of the silicon-based film containing carbon is preferably lower than a temperature at which a grain boundary of the material that forms the bonding layer grows, is preferably 200° C. or less, and is further preferably 150° C. or less. In the embodiment, the silicon-based film layer 21 containing carbon has a film thickness with which the bonding layer 15 can be sufficiently covered and protected (FIG. 2C).

Figure 2D:
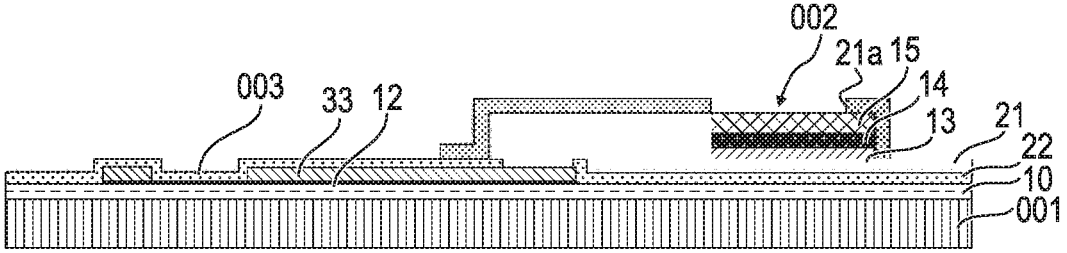

Next, a part of the covering silicon-based film containing carbon is removed through photolithography, thereby exposing a part of an upper surface of the bonding layer. In this manner, an opening 21*a* is formed in the silicon-based film layer 21 containing carbon, thereby completing the electrode pad 002 including the second wiring layer 13, the barrier metal layer 14 and the bonding layer 15. In the electrode pad, an end side surface of the barrier metal layer is covered with the silicon-based film containing carbon including the second wiring layer and the bonding layer such that no exposed portion is formed. At this time, an unnecessary silicon-based film containing carbon at least on the heat generation portion of the liquid ejection element 003 is also removed at the same time (FIG. 2D).

In the embodiment, a thin-film dry film formed with high precision is tenting-bonded to the substrate 001 in order to form the liquid ejection orifice with high precision. Then, the thin-film dry film is patterned through photolithography, thereby forming the orifice plate (ejection orifice formation member) with a film thickness of 5 and the liquid ejection orifice. In this manner, the adhesiveness improving layer that is typically provided in the related art and is obtained through spin-coating may not be provided in the embodiment.

The method of dry-etching the substrate is used for the liquid supply orifice as well for formation with high precision. Specifically, etching based on a deep-RIE method in which etching and film formation are alternately performed is performed on the substrate 001 using $SF_6$ and $C_4F_8$ as etching gas, thereby forming the liquid supply orifice. An etching protection film obtained as a by-product of the dry etching can be removed using a polymer remover solution (resist stripping solution) containing hydroxyamine.

As described above, the ink-jet recording head substrate in which an ink flowing path that communicates with the liquid ejection orifice 006 from the liquid supply orifice 007 is formed in the substrate 001 is obtained. Also, an electric circuit of the ink-jet recording head is completed by mounting a lead wiring from the electrode pad 002.

In the embodiment, the surface of the substrate (the surface of the heater protection film layer 22) to a part of an end upper surface of the bonding layer 15 of the electrode pad portion are covered with the SiCN film that is a silicon-based film containing carbon. The end side surface of the barrier metal layer 14 is protected with the SiCN film in a state in which no exposed portion is provided. Since the SiCN film has high alkali resistance, the SiCN film has resistance against the polymer remover solution containing hydroxyamine. Therefore, it is possible to curb dissolution of the titanium tungsten film that forms the barrier metal layer due to side etching in the process for manufacturing the ink-jet recording head substrate. An end of the barrier metal layer is covered and protected with the SiCN film with high alkali resistance. Therefore, in addition to the curbing of the side etching in the manufacturing process, durability against ink used for recording is improved after completion of the ink-jet recording head, and reliability of the entire ink-jet recording head is improved.

Although the film formation of the silicon-based film layer 21 containing carbon is performed after the film formation of the gold film that serves as the bonding layer 15 in the embodiment, the film formation is performed at a low temperature that is less than about 200° C. at which a grain boundary of the gold film grows. Therefore, it is possible to curb a change or a decrease in bonding properties of the bonding layer.

In the embodiment, a film layer that forms the electrode pad 002 is an independent layer from a film layer that forms the liquid ejection element 003. That is, although the wiring layer 13 (second wiring layer) of the electrode pad 002 is electrically connected to the heater wiring layer 33 (first wiring layer) of the liquid ejection element 003 through the through-hole 22*a*, the wiring layer 13 is not connected to the heater wiring layer 33 in the same layer. In a case in which ink invades the heater layer and the wiring layer inside the liquid ejection element and corrosion occurs, the corrosion due to the invasion of the ink is likely to be delivered and spread through the film layer on the same surface first. Meanwhile, since an opening area of the through-hole portion is small, and there is a step difference on upper and lower sides, corrosion spreads to the upper and lower wiring layers from the through-hole portion with a delay from a progress of the corrosion of the wiring layer in the same surface. In this regard, the configuration of the independent layers (a configuration in which a plurality of wiring layers are laminated) is more advantageous against a progress of corrosion than the film layers on the same surface. Therefore, it is possible to achieve an effect that reliability of the electrode pad portion in the ink-jet recording head can be enhanced by forming the film layer that forms the electrode pad 002 and the film layer that forms the liquid ejection element 003 as independent layers as in the embodiment.

Second Embodiment

Figure 3A:
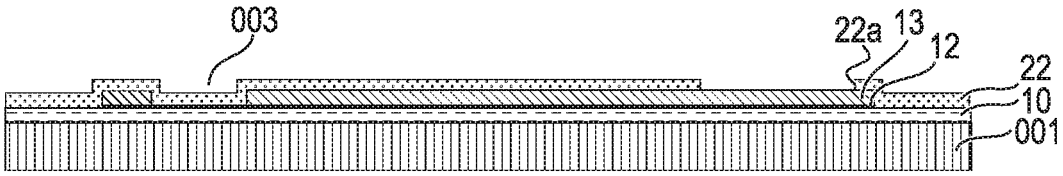
FIGS. 3A, 3B and 3C are diagrams illustrating a method for manufacturing an ink-jet recording head substrate according to a second embodiment.
Figure 3B:
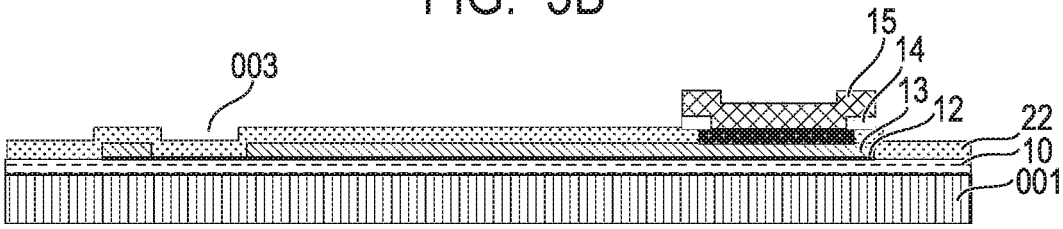
Figure 3C:
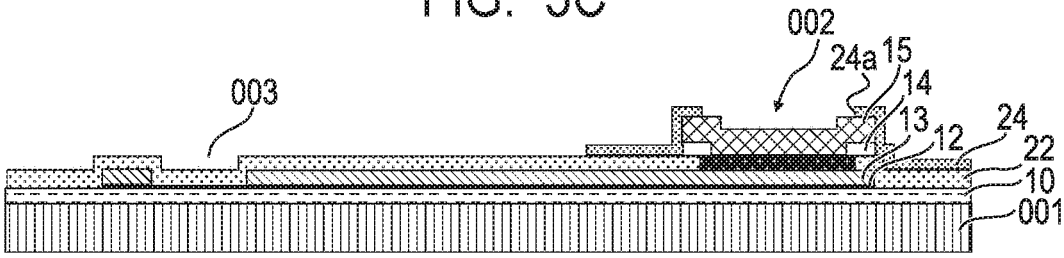

Hereinafter, a liquid ejection head substrate and a method for manufacturing the same according to an embodiment will be described with reference to FIGS. 3A to 3C. In regard to materials used for layers that form the liquid ejection head substrate, such as a substrate, an insulating film layer, a heater layer and a wiring layer, the same materials as those exemplified in the first embodiment can be used unless otherwise particularly indicated.

First, a heater layer 12 with a thickness of about 30 nm that serves as a heat generation portion of a liquid ejection element 003 and an aluminum film with a thickness of 200 nm that serves as a wiring layer 13 (first wiring layer) for supplying electric power to the liquid ejection element are formed on an insulating film layer 10 provided on a substrate 001. Further, an SiN film with a thickness of 200 nm that serves as a heater protection film layer 22 is formed. Next, patterning is performed using photolithography, thereby obtaining a configuration illustrated in FIG. 3A. The heater protection film layer 22 has a through-hole 22*a* so as to enable electrical connection to the next layer. In this manner, the heater layer that serves as a heat generation portion extends as a layer below the first wiring layer, and the heat generation portion is formed in a region that is not covered with the first wiring layer in the embodiment. Also, the heater protection film layer is formed on the heater layer of the heat generation portion and on the first wiring layer.

Next, a titanium tungsten film with a thickness of 200 nm that serves as a barrier metal layer 14 and a gold film with a thickness of 200 nm, that serves as a bonding layer 15 are successively formed through sputtering. Then, resist working is performed through photolithography, and patterning is then performed through successive etching of the bonding layer 15 and the barrier metal layer 14 by an RIE method (FIG. 3B). In this manner, the barrier metal layer 14 is formed on the wiring layer 13 such that the barrier metal layer 14 is in contact with the wiring layer 13 in the embodiment.

After the bonding layer is formed, an SiC film with a thickness of 300 nm that serves as a silicon-based film layer 24 containing carbon is formed on the entire surface through a low-temperature plasma CVD at 100° C. The silicon-based film containing carbon that forms the silicon-based film layer containing carbon preferably includes an SiCN film or an SiC film with alkali resistance. A film formation temperature of the silicon-based film containing carbon is preferably lower than a temperature at which a grain boundary of the material that forms the bonding layer grows, is preferably 200° C. or less, and is further preferably 150° C. or less. In the embodiment, the silicon-based film layer 24 containing carbon has a film thickness with which the bonding layer 15 can be sufficiently covered and protected.

Next, a part of the covering silicon-based film containing carbon is removed through photolithography, thereby exposing a part of an upper surface of the bonding layer. In this manner, an opening 24*a* is formed in the silicon-based film layer 24 containing carbon, and an electrode pad 002 provided with the wiring layer 13, the barrier metal layer 14 and the bonding layer 15 is completed. In the electrode pad, an end side surface of the barrier metal layer is covered with the silicon-based film containing carbon including the bonding layer such that no exposed portion is formed. At this time, an unnecessary silicon-based film containing carbon at least on the heat generation portion of the liquid ejection element 003 is also removed at the same time (FIG. 3C)

In the embodiment, a thin-film dry film formed with high precision is tenting-bonded to the substrate 001 in order to form the liquid ejection orifice with high precision. Then, the thin-film dry film is patterned through photolithography, thereby forming an orifice plate with a film thickness of 5 μm and a liquid ejection orifice. In this manner, the adhesiveness improving layer that is typically provided in the related art and is obtained through spin-coating may not be provided in the embodiment.

The method of dry-etching the substrate is used for the liquid supply orifice as well for formation with high precision. Specifically, etching based on a deep-RIE method in which etching and film formation are alternately performed is performed on the substrate 001 using $SF_6$ and $C_4F_8$ as etching gas, thereby forming the liquid supply orifice. An etching protection film obtained as a by-product of the dry etching can be removed using a polymer remover solution (resist stripping solution) containing hydroxyamine.

As described above, the ink-jet recording head substrate in which an ink flowing path that communicates with the liquid ejection orifice 006 from the liquid supply orifice 007 is formed in the substrate 001 is obtained. Also, an electric circuit of the ink-jet recording head is completed by mounting a lead wiring from the electrode pad 002.

In the embodiment, the surface of the substrate (the surface of the heater protection film layer 22) to a part of an end upper surface of the bonding layer 15 of the electrode pad portion are covered with the SiC film that is the silicon-based film containing carbon. The end side surface of the barrier metal layer 14 is protected with the SiC film in a state in which no exposed portion is provided. Since the SiC film has high alkali resistance, the SiC film has resistance against the polymer remover solution containing hydroxyamine. Therefore, it is possible to curb dissolution of the titanium tungsten film that forms the barrier metal layer due to side etching in the process for manufacturing the ink-jet recording head substrate. Also, an end of the barrier metal layer is covered and protected with the SiC film with high alkali resistance. Therefore, in addition to the curbing of the side etching in the manufacturing process, durability against ink used for recording is improved after completion of the ink-jet recording head, and reliability of the entire ink-jet recording head is improved.

In the embodiment, although the film formation of the silicon-based film layer 24 containing carbon is performed after the film formation of the gold film that serves as the bonding layer 15, the film formation is performed at a low temperature that is less than about 200° C. at which a grain boundary of the gold film grows. Therefore, it is possible to curb a change or a decrease in bonding properties of the bonding layer.

In the embodiment, since the wiring layer 13 is covered and protected with the heater protection film layer 22 in the related art, electric insulation and heater durable protection properties have already been secured. Thereafter, the silicon-based film layer 24 containing carbon that protects only the barrier metal layer 14 and the bonding layer 15 of the electrode pad portion may be formed. Therefore, since it is not necessary to take insulation into consideration, it is possible to form a film with enhanced alkali resistant performance even in the low-temperature film formation by focusing on the alkali resistant performance of the SiC film. In this manner, an effect that reliability of the electrode pad portion in the ink-jet recording head can be further enhanced even with a thinner film thickness can be obtained.

Third Embodiment

Hereinafter, a liquid ejection head substrate and a method for manufacturing the same according to an embodiment will be described with reference to FIGS. 4A to 4D. In regard to materials used for layers that form the liquid ejection head substrate, such as a substrate, an insulating film layer, a heater layer and a wiring layer, the same materials as those exemplified in the first embodiment can be used unless otherwise particularly indicated.

First, a heater layer 12 with a thickness of about 30 nm that serves as a heat generation portion of a liquid ejection element 003 and an aluminum film with a thickness of 200 nm that serves as a wiring layer 13 (first wiring layer) for supplying electric power to the liquid ejection element are formed on an insulating film layer 10 provided on a substrate 001. Further, an SiN film with a thickness of 200 nm that serves as a heater protection film layer 22 is formed. Next, patterning is performed using photolithography, thereby obtaining a configuration illustrated in FIG. 4A. The heater protection film layer 22 has a through-hole 22*a* so as to enable electrical connection to the next layer. In this manner, the heater layer that serves as a heat generation portion extends as a layer below the first wiring layer, and the heat generation portion is formed in a region that is not covered with the first wiring layer in the embodiment. Also, the heater protection film layer is formed on the heater layer of the heat generation portion and on the first wiring layer.

Figure 4A:
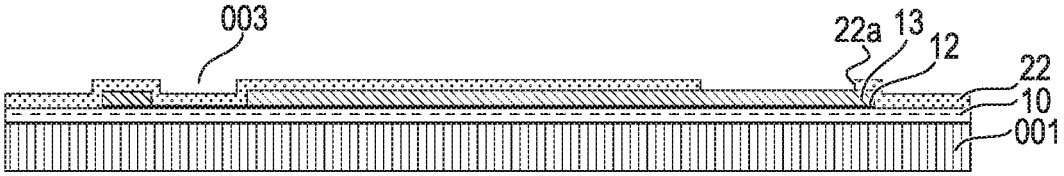
FIGS. 4A, 4B, 4C and 4D are diagrams illustrating a method for manufacturing an ink-jet recording head substrate according to a third embodiment.
Figure 4B:
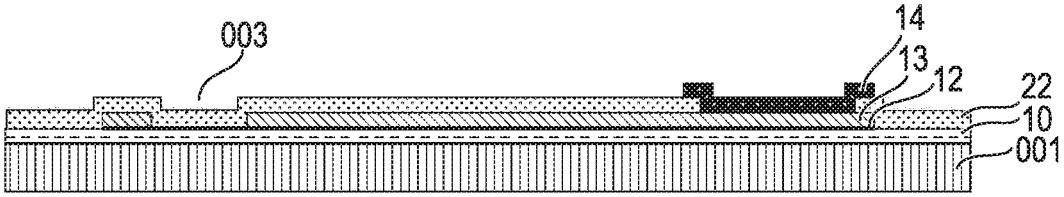

Next, a titanium tungsten film with a thickness of 200 nm that serves as a barrier metal layer 14 is sputtering-formed on the wiring layer 13 such that the titanium tungsten film is in contact with the wiring layer 13, and patterning is performed thereon (FIG. 4B).

After the barrier metal layer is formed, an SiC film with a thickness of 150 nm that serves as a silicon-based film layer 23 containing carbon is formed on the entire surface through high-temperature plasma CVD at 250° C. The silicon-based film containing carbon that forms the silicon-based film layer containing carbon preferably includes an SiCN film or an SiC film with alkali resistance. In the embodiment, the film formation temperature of the silicon-based film containing carbon is not particularly limited. However, the film formation temperature is preferably 250° C. or more in terms of durability of the silicon-based film containing carbon. In the embodiment, the silicon-based film layer 23 containing carbon has a film thickness with which the barrier metal layer 14 can be sufficiently covered and protected.

Figure 4C:
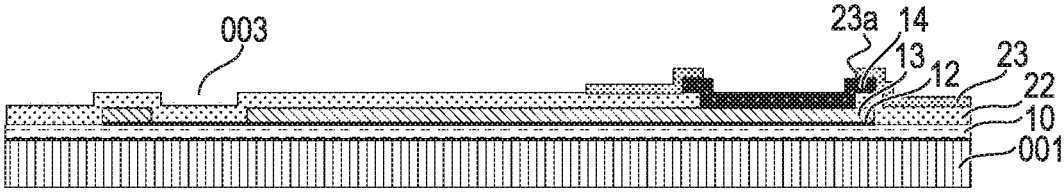

Next, a part of the covering silicon-based film containing carbon is removed through photolithography, thereby exposing a part of an upper surface of the barrier metal layer. In this manner, an opening 23*a* of the silicon-based film layer 23 containing carbon that serves as an electrode pad 002 is formed. At this time, an unnecessary silicon-based film containing carbon at least on the heat generation portion of the liquid ejection element 003 is also removed at the same time (FIG. 4C).

Figure 4D:
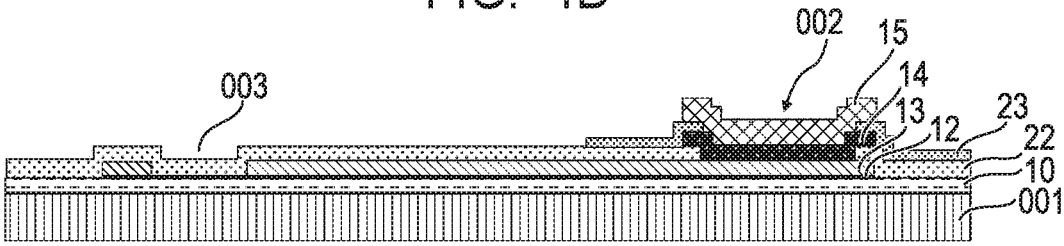

Thereafter, a gold film with a thickness of 200 nm that extends above the silicon-based film containing carbon on the barrier metal layer and that serves as a bonding layer 15 is sputtering-formed on the exposed upper surface of the barrier metal layer, and patterning is then performed thereon. In this manner, an electrode pad 002 provided with the wiring layer 13, the barrier metal layer 14 and the bonding layer 15 is completed (FIG. 4D). In the electrode pad, an end side surface of the barrier metal layer is covered with the silicon-based film containing carbon such that no exposed portion is formed.

In the embodiment, a thin-film dry film formed with high precision is tenting-bonded to the substrate 001 in order to form the liquid ejection orifice with high precision. Then, the thin-film dry film is patterned through photolithography, thereby forming an orifice plate with a film thickness of 5 μm and a liquid ejection orifice. In this manner, the adhesiveness improving layer that is typically provided in the related art and is obtained through spin-coating may not be provided in the embodiment.

The method of dry-etching the substrate is used for the liquid supply orifice as well for formation with high precision. Specifically, etching based on a deep-RIE method in which etching and film formation are alternately performed is performed on the substrate 001 using $SF_6$ and $C_4F_8$ as etching gas, thereby forming the liquid supply orifice. An etching protection film obtained as a by-product of the dry etching can be removed using a polymer remover solution (resist stripping solution) containing hydroxyamine.

As described above, the ink-jet recording head substrate in which an ink flowing path that communicates with the liquid ejection orifice 006 from the liquid supply orifice 007 is formed in the substrate 001 is obtained. Also, an electric circuit of the ink-jet recording head is completed by mounting a lead wiring from the electrode pad 002.

In the embodiment, the surface of the substrate (the surface of the heater protection film layer 22) to a part of an end upper surface of the barrier metal layer 14 of the electrode pad portion are covered with an SiC film that is a silicon-based film containing carbon. The end side surface of the barrier metal layer 14 is protected with the SiC film in a state in which no exposed portion is provided. Since the SiC film has high alkali resistance, the SiC film has resistance against the polymer remover solution containing hydroxyamine. Therefore, it is possible to curb dissolution of the titanium tungsten film that forms the barrier metal layer due to side etching in the process for manufacturing the ink-jet recording head substrate. Also, an end of the barrier metal layer is covered and protected with the SiC film with high alkali resistance. Therefore, in addition to the curbing of the side etching in the manufacturing process, durability against ink used for recording is improved after completion of the ink-jet recording head, and reliability of the entire ink-jet recording head is improved.

In the embodiment, the film formation of the silicon-based film layer 23 containing carbon is performed before the film formation of the gold film that serves as the bonding layer 15. Therefore, bonding properties of the bonding layer does not change or deteriorate even if the film formation is performed at a high temperature of about 200° C. or more at which a grain boundary of the gold film grows.

In the embodiment, since the wiring layer 13 is covered and protected with the heater protection film layer 22 in the related art, electric insulation and heater durable protection properties have already been secured. Thereafter, the silicon-based film layer 23 containing carbon that protects only the barrier metal layer 14 of the electrode pad portion may be formed. Therefore, since it is not necessary to take insulation into consideration, it is possible to form a film with enhanced alkali resistant performance without any restrictions regarding the film formation temperature by focusing on the alkali resistant performance of the SiC film. In this manner, an effect that reliability of the electrode pad portion in the ink-jet recording head can be further enhanced even with a thinner film thickness can be obtained.

Fourth Embodiment

Hereinafter, a liquid ejection head substrate and a method for manufacturing the same according to an embodiment will be described with reference to FIGS. 5A to 5F. In regard to materials used for layers that form the liquid ejection head substrate, such as a substrate, an insulating film layer, a heater layer and a wiring layer, the same materials as those exemplified in the first embodiment can be used unless otherwise particularly indicated.

Figure 5A:
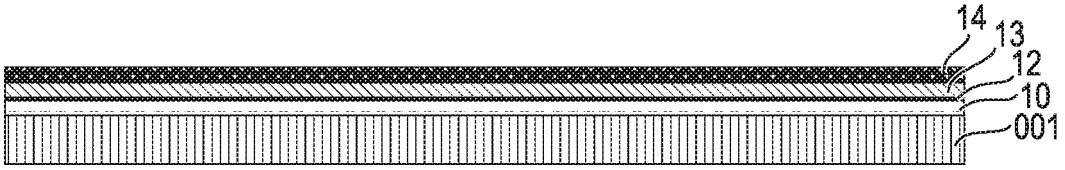
FIGS. 5A, 5B, 5C, 5D, 5E and 5F are diagrams illustrating a method for manufacturing an ink-jet recording head substrate according to a fourth embodiment.

First, layers described below are successively sputtering-formed on an insulating film layer 10 provided on a substrate 001 (FIG. 5A). That is, a heater layer 12 with a thickness of about 30 nm that serves as a heat generation portion of a liquid ejection element 003, an aluminum film with a thickness of 200 nm that serves as a wiring layer 13 (first wiring layer), and a titanium tungsten film with a thickness of 200 nm that serves as a barrier metal layer 14 are formed. In this manner, the barrier metal layer 14 is formed on the wiring layer 13 such that the barrier metal layer 14 is in contact with the wiring layer 13 that supplies electric power to the liquid ejection element in the embodiment.

Figure 5B:
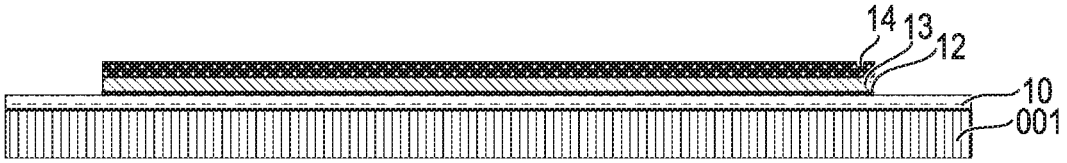

Then, successive etching is performed on the heater layer 12, the wiring layer 13 and the barrier metal layer 14 by the RIE method, thereby forming a wiring pattern (FIG. 5B).

Figure 5C:
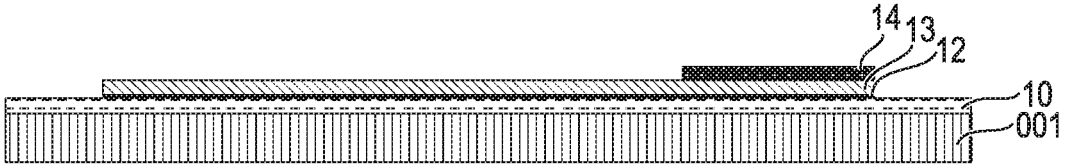

Next, wet etching using hydrogen peroxide is performed to form a pattern of the barrier metal layer 14 that serves as an electrode pad 002 (FIG. 5C).

Figure 5D:
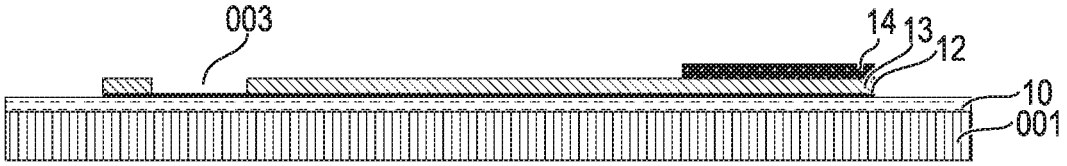

Then, the wiring layer 13 in a region that serves as the liquid ejection element 003 is removed through wet etching using a mixture solution of phosphoric acid, nitric acid and acetic acid, thereby exposing the heater layer 12 (FIG. 5D). In this manner, the heater layer that serves as a heat generation portion extends as a layer below the first wiring layer, and the heat generation portion is formed in a region that is not covered with the first wiring layer in the embodiment.

Figure 5E:
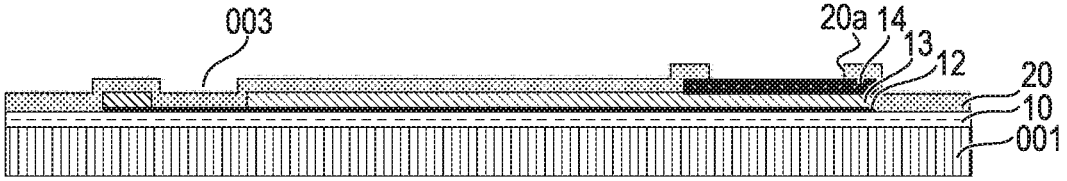

After the barrier metal layer is formed, an SiCN film with a thickness of 300 nm that serves as a silicon-based film layer 20 containing carbon is formed on the entire surface through high-temperature plasma CVD at 300° C. In the embodiment, the SiCN film covers the heater layer in contact with the heater layer at the heat generation portion. That is, the SiCN film is also formed on the heater layer 12 in the region that serves as the liquid ejection element 003 and also serves as a heater protection film that covers and protects the liquid ejection element. The silicon-based film containing carbon that forms the silicon-based film layer containing carbon preferably includes an SiCN film or an SiC film with alkali resistance. In the embodiment, the film formation temperature of the silicon-based film containing carbon is not particularly limited. However, the film formation temperature is preferably 250° C. or more in terms of durability of the heater protection film (the silicon-based film containing carbon). The film formation temperature is preferably equal to or greater than a temperature that the surface of the silicon-based film containing carbon reaches due to driving of the liquid ejection element and is particularly preferably 300° C. or more. The silicon-based film layer 20 containing carbon has a film thickness with which the barrier metal layer 14 can be sufficiently covered and protected. Then, a part of the covering silicon-based film containing carbon is removed through photolithography to expose a part of an upper surface of the barrier metal layer, and an opening 20*a* of the silicon-based film layer 20 containing carbon that serves as an electrode pad 002 is formed (FIG. 5E). At this time, the silicon-based film containing carbon covering the heater layer in a contact manner remains as a heater protection film layer.

Figure 5F:
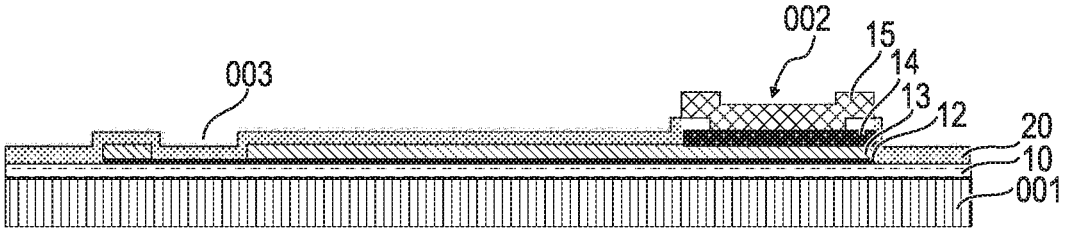

Thereafter, a gold film with a thickness of 200 nm that extends above the silicon-based film containing carbon on the barrier metal layer and that serves as a bonding layer 15 is sputtering-formed on the exposed upper surface of the barrier metal layer, and patterning is then performed thereon. In this manner, the electrode pad 002 provided with the wiring layer 13, the barrier metal layer 14 and the bonding layer 15 is completed (FIG. 5F). In the electrode pad, an end side surface of the barrier metal layer is covered with the silicon-based film containing carbon including the wiring layer such that no exposed portion is formed.

In the embodiment, a thin-film dry film formed with high precision is tenting-bonded to the substrate 001 in order to form the liquid ejection orifice with high precision. Then, the thin-film dry film is patterned through photolithography, thereby forming an orifice plate with a film thickness of 5 μm and a liquid ejection orifice. In this manner, the nozzle adhesiveness improving layer that is typically provided in the related art and is obtained through spin-coating may not be provided in the embodiment.

The method of dry-etching the substrate is used for the liquid supply orifice as well for formation with high precision. Specifically, etching based on a deep-RIE method in which etching and film formation are alternately performed is performed on the substrate 001 using $SF_6$ and $C_4F_8$ as etching gas, thereby forming the liquid supply orifice. An etching protection film obtained as a by-product of the dry etching can be removed using a polymer remover solution (resist stripping solution) containing hydroxyamine.

As described above, the ink-jet recording head substrate in which an ink flowing path that communicates with the liquid ejection orifice 006 from the liquid supply orifice 007 is formed in the substrate 001 is obtained. Also, an electric circuit of the ink-jet recording head is completed by mounting a lead wiring from the electrode pad 002.

In the embodiment, the surface of the substrate up to a part of an end upper surface of the barrier metal layer 14 of the electrode pad portion are covered with the SiCN film that is a silicon-based film containing carbon, and the end side surface of the barrier metal layer 14 is protected in a state in which no exposed portion is provided. Since the SiCN film has high alkali resistance, the SiCN film has resistance against the polymer remover solution containing hydroxyamine. Therefore, it is possible to curb dissolution of the titanium tungsten film that forms the barrier metal layer due to side etching in the process for manufacturing the ink-jet recording head substrate. An end of the barrier metal layer is covered and protected with the SiCN film with high alkali resistance. Therefore, in addition to the curbing of the side etching in the manufacturing process, durability against ink used for recording is improved after completion of the ink-jet recording head, and reliability of the entire ink-jet recording head is improved.

In the embodiment, the film formation of the silicon-based film layer 20 containing carbon is formed before the film formation of the gold film that serves as the bonding layer 15. Therefore, bonding properties of the bonding layer does not change or deteriorate even of the film formation is performed at a high temperature of about 200° C. or more at which a grain boundary of the gold film grows. Therefore, it is possible to form the SiCN film that serves as the silicon-based film layer 20 containing carbon without any restrictions regarding the film formation temperature in the embodiment. In this manner, it is possible to achieve all the electric insulation, the heater durable protection properties, and the barrier metal layer protection properties, which are difficult to be realized together. Since the liquid ejection element 003 instantaneously reaches a high temperature of 300° C. or more, in particular, it is particularly preferable to form the silicon-based film containing carbon at a high temperature of 300° C. or more in terms of durability of the heater protection film.

In the embodiment, the silicon-based film containing carbon also serves as a heater protection film that protects the upper surface from which the heater layer is exposed. That is, it is possible to protect both the heater portion and the electrode pad portion with the same silicon-based film containing carbon. Therefore, it is possible to obtain an effect that the manufacturing process is simplified and reliability of the electrode pad portion in the ink-jet recording head can be further enhanced at low costs according to the embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-235022, filed Dec. 17, 2018, which is hereby incorporated by reference herein in its entirety.

What is claimed is:

1. A liquid ejection head substrate comprising:

a substrate;

a liquid ejection element that generates liquid ejection energy on the substrate; and an electrode pad that is electrically connected to the liquid ejection element, wherein the electrode pad includes a barrier metal layer and a bonding layer on the barrier metal layer, and an end side surface of the barrier metal layer is covered with a silicon-based film containing carbon.

2. The liquid ejection head substrate according to claim 1, further comprising:

a first wiring layer that supplies electric power to the liquid ejection element; and a second wiring layer that is provided between the first wiring layer and the barrier metal layer in a lamination direction and electrically connects the first wiring layer to the barrier metal layer.

3. The liquid ejection head substrate according to claim 1, further comprising:

a first wiring layer that supplies electric power to the liquid ejection element, wherein the first wiring layer is in contact with the barrier metal layer.

4. The liquid ejection head substrate according to claim 1, wherein the liquid ejection element is an electrothermal conversion element.

5. The liquid ejection head substrate according to claim 4, wherein the silicon-based film containing carbon also serves as a protection film that covers the electrothermal conversion element.

6. The liquid ejection head substrate according to claim 1, wherein the silicon-based film containing carbon covers a surface of the substrate up to a part of an end upper surface of the barrier metal layer or of the bonding layer.

7. The liquid ejection head substrate according to claim 1, wherein a material that forms the bonding layer is gold.

8. The liquid ejection head substrate according to claim 1, wherein a material that forms the barrier metal layer is titanium-based metal or tantalum-based metal.

9. The liquid ejection head substrate according to claim 1, wherein the silicon-based film containing carbon is an SiC film or an SiCN film.

10. The liquid ejection head substrate according to claim 1, wherein an end side surface of the barrier metal layer is covered with the silicon-based film containing carbon with no exposed portion formed.

11. A method for manufacturing a liquid ejection head substrate that includes a substrate, a liquid ejection element that generates liquid ejection energy on the substrate, and an electrode pad that includes a barrier metal layer and a bonding layer on the barrier metal layer and is electrically connected to the liquid ejection element, the method comprising:

covering an end side surface of the barrier metal layer with a silicon-based film containing carbon.

12. The method for manufacturing a liquid ejection head substrate according to claim 11, further comprising:

forming a first wiring layer that supplies electric power to the liquid ejection element;

forming a second wiring layer on the first wiring layer;

forming the barrier metal layer on the second wiring layer; and forming the bonding layer on the barrier metal layer, wherein the covering of the end side surface of the barrier metal layer is performed such that at least the end side surface of the barrier metal layer and the bonding layer are covered with the silicon-based film containing carbon after the bonding layer is formed, and the method further includes removing a part of the covering silicon-based film containing carbon, thereby exposing a part of an upper surface of the bonding layer.

13. The method for manufacturing a liquid ejection head substrate according to claim 11, further comprising:

forming a first wiring layer that supplies electric power to the liquid ejection element;

forming the barrier metal layer on the first wiring layer such that the barrier metal layer is in contact with the first wiring layer; and forming the bonding layer on the barrier metal layer, wherein the covering of the end side surface of the barrier metal layer is performed such that at least the end side surface of the barrier metal and the bonding layer are covered with the silicon-based film containing carbon after the bonding layer is formed, and the method further includes removing a part of the covering silicon-based film containing carbon, thereby exposing a part of an upper surface of the bonding layer.

14. The method for manufacturing a liquid ejection head substrate according to claim 12, wherein in the covering of the end side surface of the barrier metal layer, the silicon-based film containing carbon is formed at a temperature lower than a temperature at which a grain boundary of a material that forms the bonding layer grows.

15. The method for manufacturing a liquid ejection head substrate according to claim 12, wherein a material that forms the bonding layer is gold, and in the covering of the end side surface of the barrier metal layer, the silicon-based film containing carbon is formed at 150° C. or less.

16. The method for manufacturing a liquid ejection head substrate according to claim 11, further comprising:

forming a first wiring layer that supplies electric power to the liquid ejection element; and forming the barrier metal layer on the first wiring layer such that the barrier metal layer is in contact with the first wiring layer, wherein the covering of the end side surface of the barrier metal layer is performed such that at least the barrier metal layer is covered with the silicon-based film containing carbon after the barrier metal layer is formed, and the method further includes removing a part of the covering silicon-based film containing carbon, thereby exposing a part of an upper surface of the barrier metal layer, and forming, on the exposed upper surface of the barrier metal layer, the bonding layer so as to extend above the silicon-based film containing carbon on the barrier metal layer.

17. The method for manufacturing a liquid ejection head substrate according to claim 16, wherein the liquid ejection element is an electrothermal conversion element, and in the covering of the end side surface of the barrier metal layer, a protection film that covers the electrothermal conversion element with a part of the silicon-based film containing carbon is formed.

18. The method for manufacturing a liquid ejection head substrate according to claim 16, wherein in the covering of the end side surface of the barrier metal layer, the silicon-based film containing carbon is formed at 250° C. or more.

19. The method for manufacturing a liquid ejection head substrate according to claim 17, wherein in the covering of the end side surface of the barrier metal layer, the silicon-based film containing carbon is formed at a temperature that is equal to or greater than a temperature which a surface of the silicon-based film containing carbon reaches due to driving of the liquid ejection element.

20. The method for manufacturing a liquid ejection head substrate according to claim 17, wherein in the covering of the end side surface of the barrier metal layer, the silicon-based film containing carbon is formed at 300° C. or more.

* * * * *